US005492335A

United States Patent [19]

Videnov

[11] Patent Number: 5,492,335

[45] Date of Patent: Feb. 20, 1996

[54] VARIABLE SOUND PRODUCING TETHERED BALL TOY

[76] Inventor: Anton Y. Videnov, 1400 Hubbell Pl. #1114, Seattle, Wash. 98101

[21] Appl. No.: 393,198

[22] Filed: Feb. 23, 1995

[51] Int. Cl.[6] ..... A63B 43/00; A63B 67/10

[52] U.S. Cl. ..... 273/414; 273/58 C; 273/58 E

[58] Field of Search ..... 273/414, 58 C, 273/58 E, 329, 331

[56] References Cited

U.S. PATENT DOCUMENTS

| | | | |
|---|---|---|---|
| D. 309,475 | 7/1990 | Salehzadeh et al. | D21/62 |
| D. 319,672 | 9/1991 | Blecha | D21/62 |
| 612,173 | 10/1898 | Newton | 273/58 C |
| 672,099 | 4/1901 | Jackson | 273/58 C |
| 3,157,962 | 11/1964 | Bonnelly | 273/58 C X |
| 3,785,643 | 1/1974 | Rich | 273/58 C X |
| 4,062,542 | 12/1977 | Manera | 273/414 |
| 4,300,771 | 11/1981 | Lori | 273/329 |
| 4,346,902 | 8/1982 | Warehime | 273/58 C X |
| 4,739,995 | 4/1988 | Yackel, Jr. | 273/331 |
| 5,181,726 | 1/1993 | Piaget | 273/414 |

*Primary Examiner*—William H. Grieb

[57] ABSTRACT

A variable sound producing tethered ball toy comprising of a cord having two flat ends, a clip being formed in a rectangular configuration with a cross bar positioned thereacross, the cord being threaded through the clip causing the cord to be bent back upon itself, the two free ends of the cord depending from the clip; a first ball fabricated of synthetic materials and formed in a spherical configuration, a free end of the cord being securely affixed to the ball; and a second ball fabricated of synthetic materials and formed in a spherical configuration, a free end of the cord being securely affixed to the ball; and at least one of the balls including a plurality of strips of synthetic material position on its surface, each strip emitting a different sound when struck by a ball.

8 Claims, 5 Drawing Sheets

VARIABLE SOUND PRODUCING TETHERED BALL TOY

BACKGROUND OF THE INVENTION

1. Field of the Invention

The present invention relates to a variable sound producing tethered ball toy and more particularly pertains to producing a variety of sounds by causing the balls of the apparatus to collide with each other.

2. Description of the Prior Art

The use of tethered ball toys is known in the prior art. More specifically, tethered ball toys heretofore devised and utilized for the purpose of entertaining users by moving the apparatus in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 4,739,995 to Yackel discloses a tethered ball toy.

U.S. Pat. No. 3,785,643 to Rich discloses a erratic movement tethered ball striking toy.

U.S. Pat. No. 4,300,771 to Lori discloses a ball and string skill toy.

U.S. Pat. Des. No. 309,475 to Salehzadeh discloses a colliding ball toy.

Lastly, U.S. Pat. Des. No. 319,672 to Blecha discloses a colliding ball toy.

In this respect, the variable sound producing tethered ball toy according to the present invention substantially departs from the conventional concepts and designs of the prior art, and in doing so provides an apparatus primarily developed for the purpose of producing a variety of sounds by causing the balls of the apparatus to collide with each other.

Therefore, it can be appreciated that there exists a continuing need for a new and improved variable sound producing tethered ball toy which can be used for producing a variety of sounds by causing the balls of the apparatus to collide with each other. In this regard, the present invention substantially fulfills this need.

SUMMARY OF THE INVENTION

In view of the foregoing disadvantages inherent in the known types of tethered ball toys now present in the prior art, the present invention provides an improved variable sound producing tethered ball toy. As such, the general purpose of the present invention, which will be described subsequently in greater detail, is to provide a new and improved variable sound producing tethered ball toy and method which has all the advantages of the prior art and none of the disadvantages.

To attain this, the present invention essentially comprises a new and improved variable sound producing tethered ball toy comprising, in combination: a cord fabricated of synthetic materials, the cord having two free ends and a central region therebetween, the central region of the cord having a flexible pad positioned therearound, a clip being formed in a generally rectangular configuration with a large central aperture and a cross bar positioned across the aperture, the clip adapted to be positioned adjacent to the free ends of the pad, the cord being threaded through the clip causing the padded area to be bent back upon itself forming a generally oval configuration, the two free ends of the cord depending from the clip, the pad adapted to be positioned around the index and middle finger of the user in the operative orientation; a first ball fabricated of hard solid plastic and formed in a generally spherical configuration, the first ball having a bore extending therein, the bore adapted to receive a free end of the cord, the free end being securely affixed within the bore with glue; and a second ball fabricated of hard essentially solid plastic and formed in an essentially spherical configuration, the second ball having a bore extending therein, the bore adapted to receive a free end of the cord, the free end being securely affixed within the bore with glue, the ball including a generally rectangular shaped groove extending horizontally around its approximate midpoint, a plurality of sound boxes being fabricated of synthetic materials and having differing widths, the sound boxes being positioned within the groove and separated from each other by a short distance, the relative width of each sound box causing different sounds to emanate therefrom when colliding with the first ball, the balls adapted to spin horizontally at a ninety degree angle with respect to the cord, the spinning balls colliding randomly with each other thereby causing random sound generation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved variable sound producing tethered ball toy which has all of the advantages of the prior art tethered ball toys and none of the disadvantages.

It is another object of the present invention to provide a new and improved variable sound producing tethered ball toy which may be easily and efficiently manufactured and marketed.

It is further object of the present invention to provide a new and improved variable sound producing tethered ball toy which is of durable and reliable constructions.

An even further object of the present invention is to provide a new and improved variable sound producing tethered ball toy which is susceptible of a low cost of manufacture with regard to both materials and labor, and which accordingly is then susceptible of low prices of sale to the consuming public, thereby making such variable sound producing tethered ball toy economically available to the buying public.

Still yet another object of the present invention is to provide a new and improved variable sound producing tethered ball toy which provides in the apparatuses and methods of the prior art some of the advantages thereof, while simultaneously overcoming some of the disadvantages normally associated therewith.

Still another object of the present invention is to produce a variety of sounds by causing the balls of the apparatus to collide with each other.

Lastly, it is an object of the present invention to provide a new and improved a variable sound producing tethered ball toy comprising of a cord having two flat ends, a clip being formed in a rectangular configuration with a cross bar positioned thereacross, the cord being threaded through the clip causing the cord to be bent back upon itself, the two free ends of the cord depending from the clip; a first ball fabricated of synthetic materials and formed in a spherical configuration, a free end of the cord being securely affixed to the ball; and a second ball fabricated of synthetic materials and formed in a spherical configuration, a free end of the cord being securely affixed to the ball; and at least one of the balls including a plurality of strips of synthetic material position on its surface, each strip emitting a different sound when struck by a ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
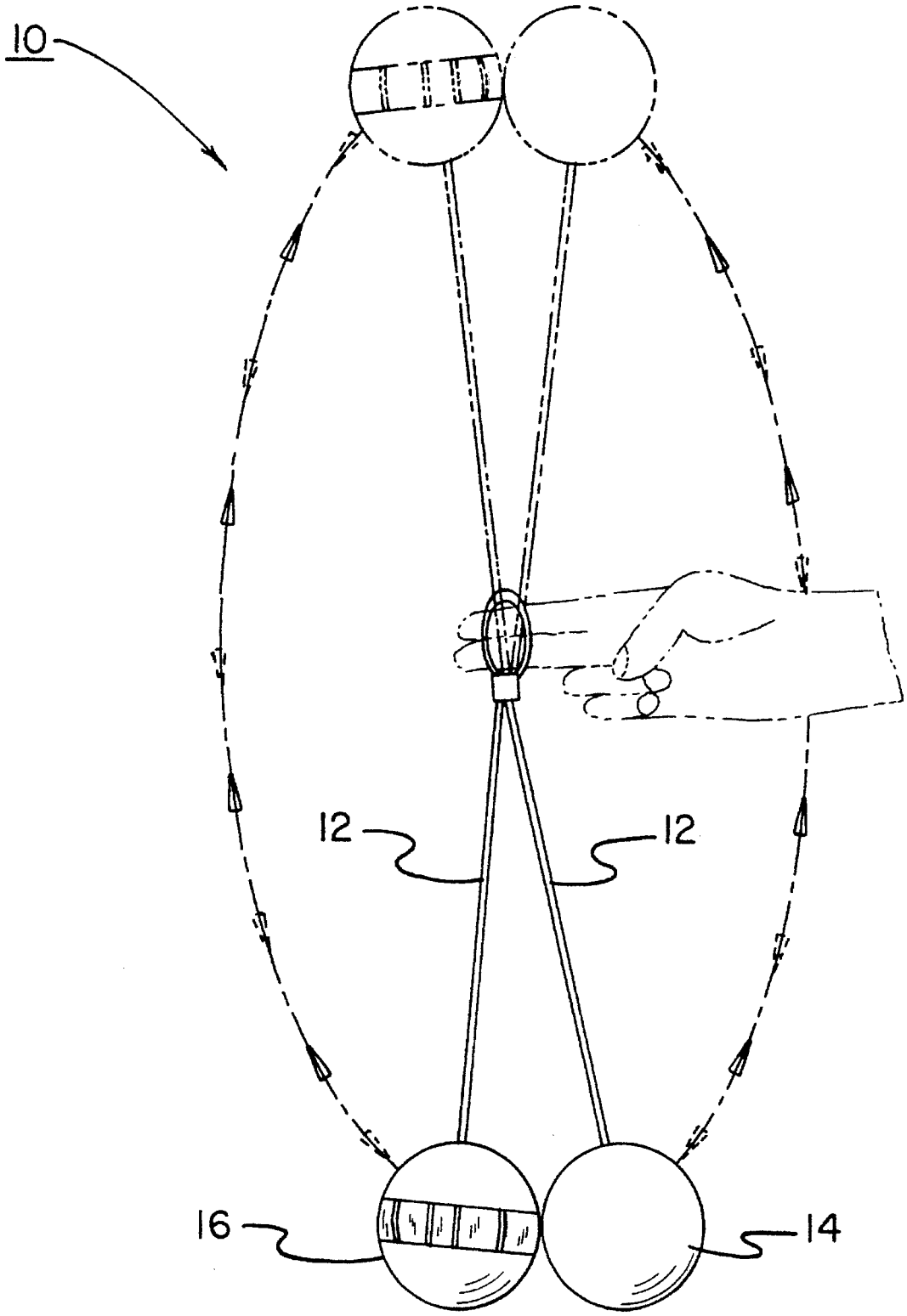
FIG. 1 is a perspective view of the preferred embodiment of the variable sound producing tethered ball toy constructed in accordance with the principles of the present invention.

With reference now to the drawings, and in particular to FIG. 1 thereof, the preferred embodiment of the new and improved variable sound producing tethered ball toy embodying the principles and concepts of the present invention and generally designated by the reference numeral 10 will be described.

The present invention, the variable sound producing tethered ball toy 10 is comprised of a plurality of components. Such components in their broadest context include a cord 12, a first ball 14, a second ball 16. Such components are individually configured and correlated with respect to each other so as to attain the desired objective.

Figure 2:
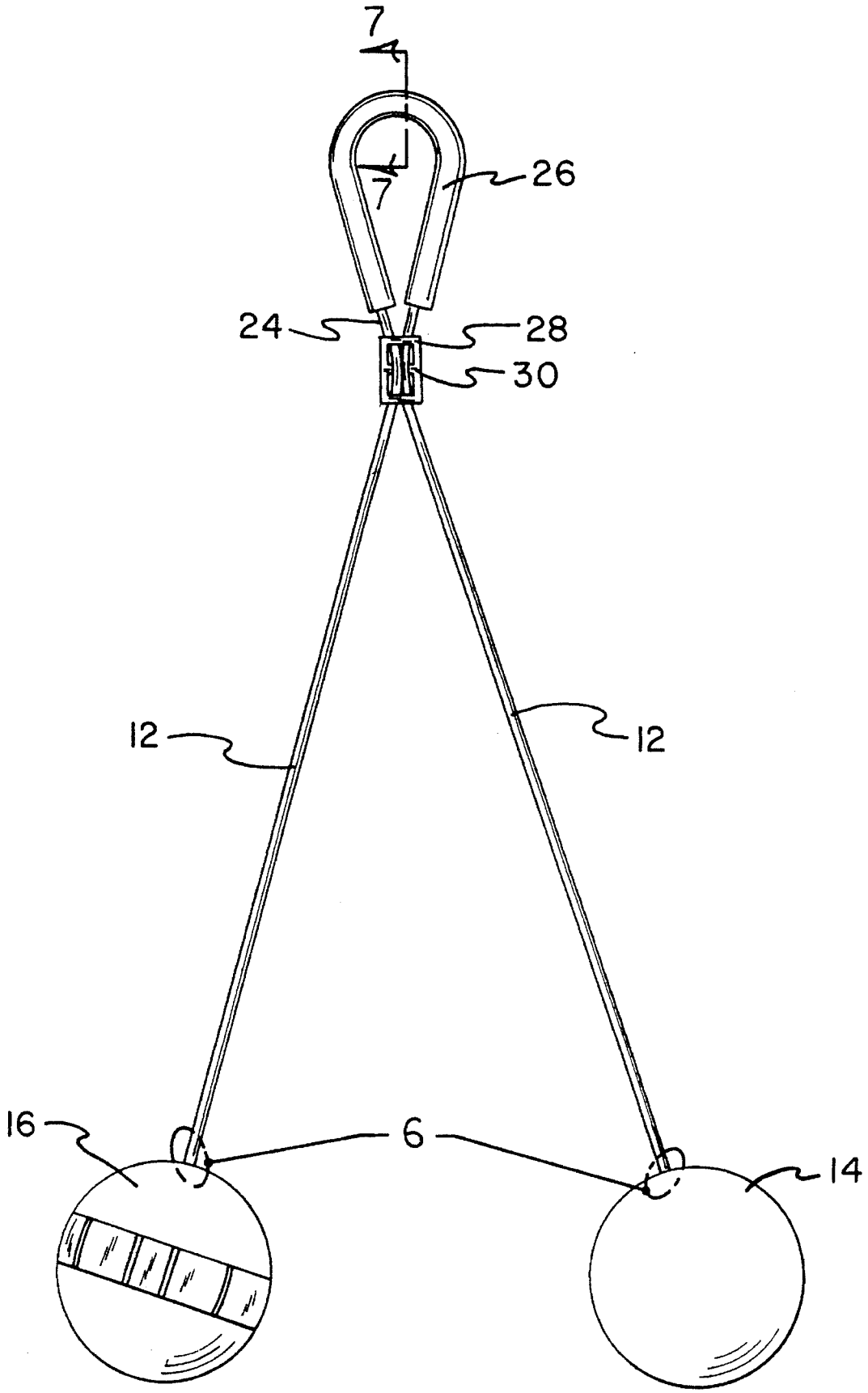
FIG. 2 is a perspective view of the apparatus shown in FIG. 1 while in the inoperative orientation.
Figure 7:
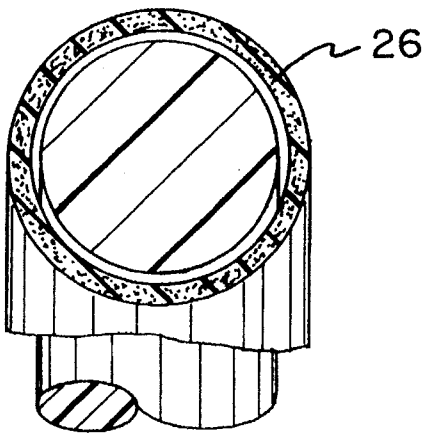
FIG. 7 is a cross sectional view of the pad on the cord of the apparatus taken along line 6—6 of FIG. 2.

More specifically, the cord is fabricated of synthetic materials and is about one eight of an inch in diameter. A nylon is the preferred material for the cord and provides the apparatus with the strength and durability necessary to withstand the forces applied during use. The cord has two free ends 20, 22 and a central region 24 therebetween. The central region 24 of the cord has a flexible pad 26 positioned therearound it. Note FIG. 7. The pad is adapted to be positioned around the users fingers in the operative orientation. The pad prevents blistering of the users fingers during use. The pad may be fabricated of foam, rubber or some other soft flexible material. Note FIGS. 1 and 2.

Figure 9:
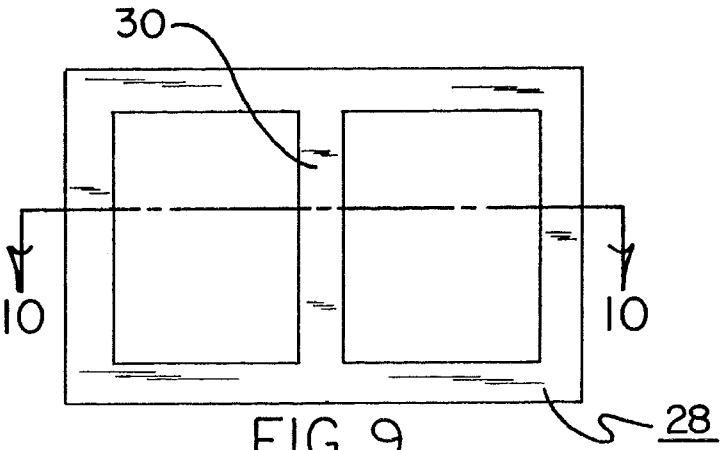
FIG. 9 is a perspective view of the clip of the apparatus.

A quarter inch clip 28 is formed in a generally rectangular configuration with a large central aperture and a cross bar 30 positioned across the aperture. The clip is adapted to be positioned adjacent to the free ends of the pad. The cord is threaded through the clip causing the padded area to be bent back upon itself forming a generally oval configuration. To thread the cord through the loop the user first places the folded center point of the cord through the aperture and over the cross bar of the clip. The user then threads the looped cord back through the aperture. The clip holds the cord adjacent to the ends of the pad securely in place. Note FIGS. 2 and 9.

Figure 10:
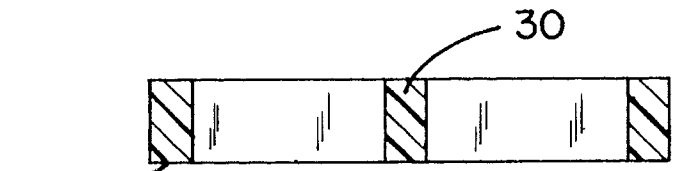
FIG. 10 is a cross sectional view of clip of the apparatus taken along line 10—10 of FIG. 9.

The generally oval shape formed by the bent pad is adapted to fit around the index and middle fingers of the user. The width of the padded area can be expanded by adjusting the clip downward toward the balls of the apparatus. Note FIGS. 9 and 10. The cord is about fifteen inches long. In an alternative embodiment of the apparatus it could made longer or shorter to suit the users preference. The two free ends of the cord depend from the clip in the operative orientation. Note FIGS. 1, 2 and 7.

Figures 3, 4, 5:
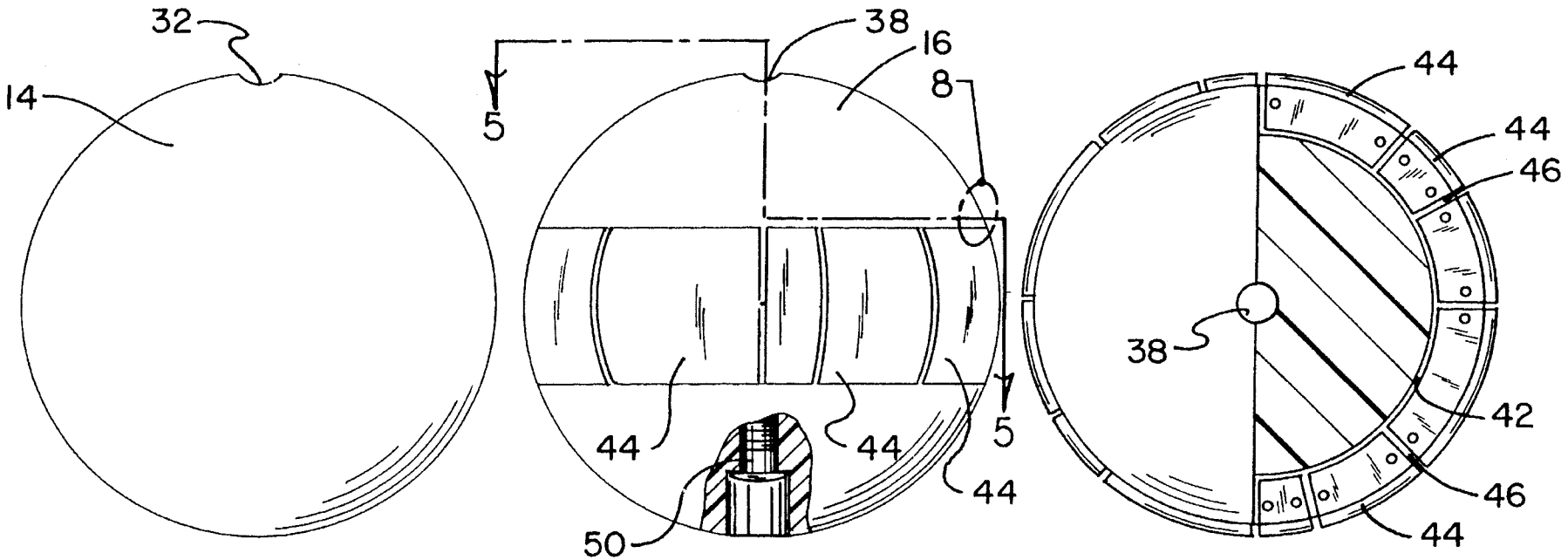
FIG. 3 is a perspective view of the first ball shown separated from the cord of the apparatus.
FIG. 4 is a partially broken away perspective view of the second ball shown separated from the cord of the apparatus.
FIG. 5 is a cross sectional view of the second ball of the apparatus taken along line 5—5 of FIG. 4.
Figure 6:
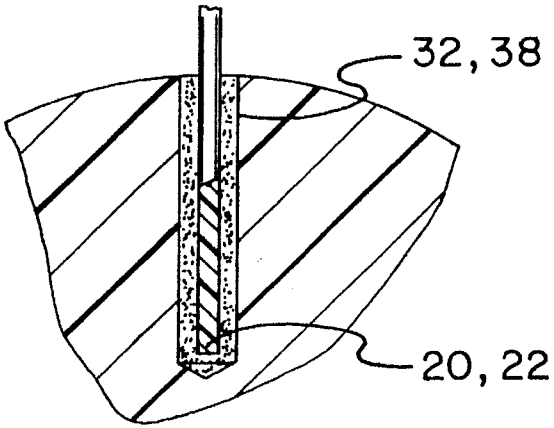
FIG. 6 is a cross sectional view of the bores in the balls of the apparatus taken along line 6—6 of FIG. 2.

A first ball is fabricated of hard solid plastic and formed in a generally spherical configuration. Note FIG. 3. The first and second balls are manufactured of sturdy flexible materials. The sturdy materials permit the balls to withstand the collisions with each other without chipping or breaking. The balls are approximately the same size as a standard golf ball. The first ball has a bore 32 extending within it. The bore is adapted to receive a free end 20 of the cord. About a one inch segment of the cord is securely affixed within the bore with glue. The bore is sufficiently large to contain both the cord and an amount of glue sufficient to retain the cord therein. The permanent affixation of the free ends of the cord within the balls enables the apparatus to withstand the centripetal forces applied during use. Note FIGS. 1, 2 and 6.

Figure 8:
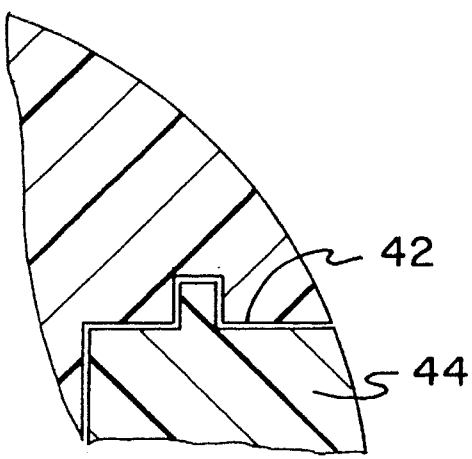
FIG. 8 is a cross sectional view of a sound box in the second ball of the apparatus taken along line 8—8 of FIG. 4.

A second ball 16 is fabricated of hard essentially solid plastic and formed in an essentially spherical configuration. Note FIG. 4. The second ball has a bore 38 extending within it. The bore is adapted to receive the second free end 22 of the cord. The free end is securely affixed within the bore with glue. Similar to the construction of the first ball, the second ball permanently retains the free ends of the cord to withstand the centripetal forces applied during use. The ball includes a generally rectangular shaped groove 42 extending horizontally around its approximate midpoint. The plane of the grove is positioned at about a ninety degree angle with respect to the plane of the cord in the operative orientation. The groove extends a short distance within the second ball. Note FIGS. 5 and 8.

A plurality of sound boxes 44 are fabricated of synthetic materials and have varying horizontal widths. The preferred materials are Kelon or Klyperon. The sound boxes are positioned within the groove and are separated from each other by a short distance 46. The relative horizontal width of each sound box causes different sounds to emanate from them when collisions occur with the first ball. The different horizontal widths cause different frequency sounds to emanate from the perspective sound boxes. Note FIGS. 4, 5 and 8.

The spaces between each sound box prevent contamination of the individual sound frequencies. In some cases the first ball may contact with up to two separate sound boxes at one time. To begin utilizing the apparatus the user first loops the pad around it middle index finger. The user then grasps one of the balls and strikes the ball with it causing both balls to swing. The user than makes a slight up and down motion with the operative hand to cause the collisions to increase in intensity, ultimately the balls will collide both above and below the users hand at high speed. The high speed collisions causing a plurality of random sound generations. Note FIGS. 1, 2 and 5.

Figure 12:
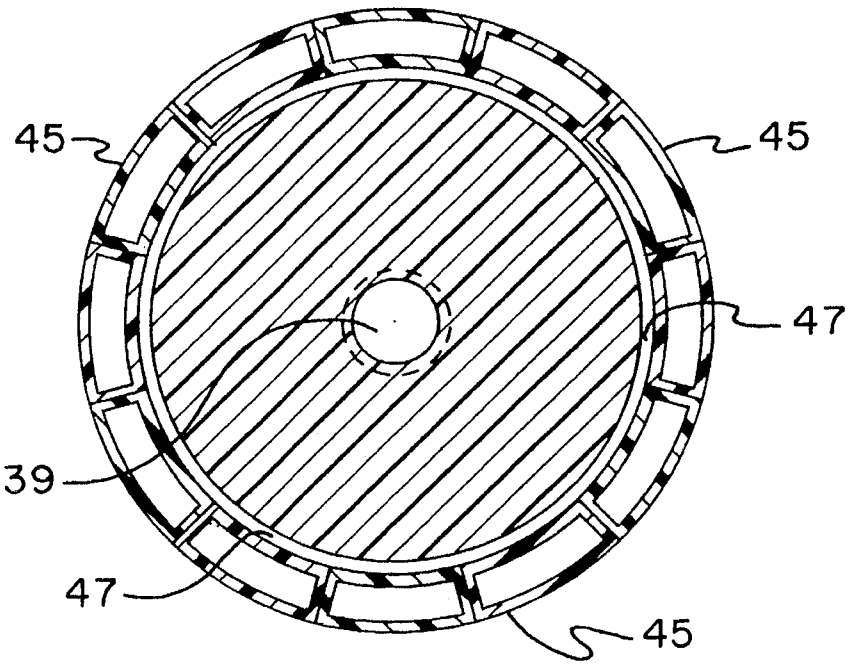
FIG. 12 is a cross sectional view of the ball shown in FIG. 11 taken along line 12—12 of FIG. 11.
Figure 11:
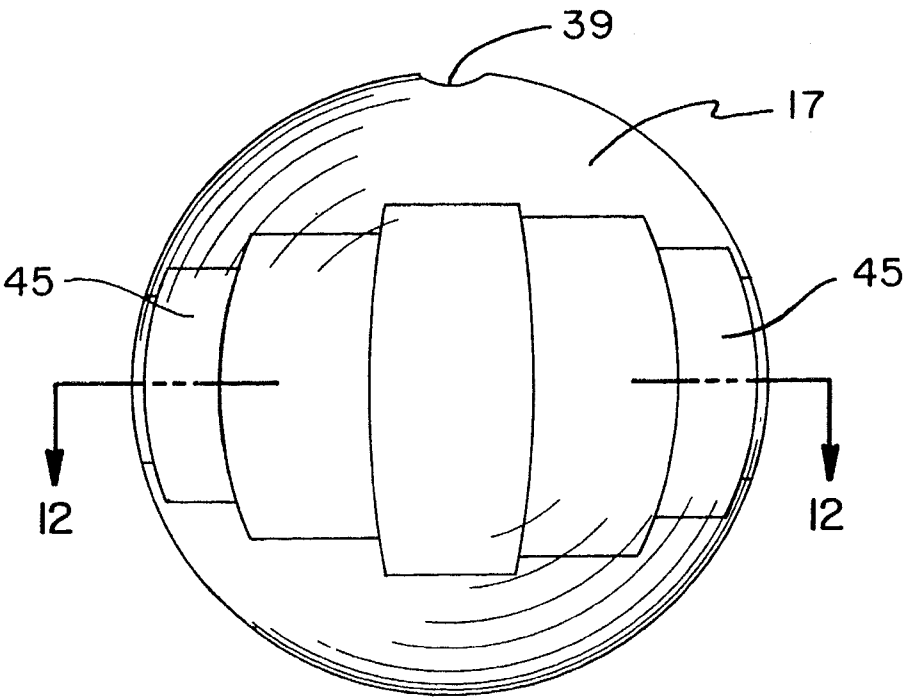
FIG. 11 is a front elevational view of a ball constructed in accordance with an alternate embodiment of the invention.

In an alternative embodiment of the apparatus at least one of the balls includes sound boxes which are formed in a long thin configuration. Note FIGS. 11 and 12. Two or more of the sound boxes 45 have a different vertical length. The sound boxes are positioned within the surface of the ball 17. A first sound box has the longest length. A last sound box measures about one half inch in length and has the shortest length. The first and last sound boxes are positioned adjacent to each other. A plurality of sound boxes of gradually decreasing vertical length are positioned around the ball between the first and last sound box with separations 47 therebetween. The vertical arrangement is another method of creating a wide variety of different sounds resulting from collisions of the balls. Each ball, as in the other embodiments of the invention, is formed with bores 39 for the reception of a cord for facilitating the use of the balls.

The balls also spin horizontally at a ninety degree angle with respect to the cord. Note FIG. 15. This further enhances the randomness of the sound generations during use. The clip of the apparatus helps prevent knotting of the cord when horizontal rotation occurs. Note FIGS. 2, 4 and 9.

In an alternative embodiment of the apparatus the second ball is divided into two separate hemispheres. An upper hemisphere has a bolt bore extending within it. A lower hemisphere has a bolt aperture extending through it. The edge of each hemisphere includes a groove extending within it. The sound boxes are positioned within the grooves and are separated from each other by a short distance. A bolt 50 is formed in a long cylindrical configuration and is positioned through the bolt aperture and into the bolt bore. The bolt couples the two hemispheres together and secures the sound boxes within the grooves. The bolt is positioned perpendicular to the plane of the groove. This configuration allows the user to easily disassemble the apparatus when desired. Additionally, the coupling of the sound boxes within the grooves by means of a bolt permits virtually unhindered vibration of the sound boxes thereby enhancing sound quality. Note FIG. 4.

The variable sound producing tethered ball toy consists of two hard plastic balls approximately the same size as golf balls. The approximate weight of each ball is forty five grams. The apparatus includes a fifteen inch long nylon cord and a one quarter inch adjustable clip. The two balls are securely fastened to the ends of the cord. The total weight of the apparatus is about one hundred grams.

A soft comfortable pad is fastened to the center of the cord. The user's fingers are positioned through the pad. One ball is made of plain plastic and the other has a one half inch wide strip containing square sound boxes. The sound boxes are from a different size material and produces different sounds when struck by the opposing ball. An alternative embodiment of the apparatus includes different length vertical sound bar strips. A long strip is positioned vertically in the center of the ball. Decreasingly shorter strips are positioned therearound until one strip's length measures one half inch.

To play the game, the user makes a fist, raises the index and middle finger, and positions them straight out in a line. Next the user forms a loop in about the middle of the cord and slips it over the two fingers. The clip is then placed over the loop below the fingers and adjusted to fit comfortably, while also preventing the cord from slipping off the fingers. With the free hand, the user grasps one ball and strikes the other ball with it. This causes the balls to swing up and down hitting each other in the process. As the balls swing they also spin horizontally, causing different sound boxes to be struck and thereby producing different sounds. The variable sound producing tethered ball toy is an enjoyable game that can be played by anyone, indoors or outdoors. It can be carried in one's purse or pocket.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved variable sound producing tethered ball toy comprising, in combination:

a cord fabricated of synthetic materials, the cord having two free ends and a central region therebetween, the central region of the cord having a flexible pad positioned therearound, a clip being formed in a generally rectangular configuration with a large central aperture and a cross bar positioned across the aperture, the clip adapted to be positioned adjacent to the free ends of the pad, the cord being threaded through the clip causing the padded area to be bent back upon itself forming a generally oval configuration, the two free ends of the cord depending from the clip, the pad adapted to be positioned around the index and middle finger of the user in the operative orientation;

a first ball fabricated of hard solid plastic and formed in a generally spherical configuration, the first ball having a bore extending therein, the bore adapted to receive a free end of the cord, the free end being securely affixed within the bore with glue; and a second ball fabricated of hard essentially solid plastic and formed in an essentially spherical configuration, the second ball having a bore extending therein, the bore adapted to receive a free end of the cord, the free end being securely affixed within the bore with glue, the ball including a generally rectangular shaped groove extending horizontally around its approximate midpoint, a plurality of sound boxes being fabricated of synthetic materials and having differing widths, the sound boxes being positioned within the groove and separated from each other by a short distance, the relative width of each sound box causing different sounds to emanate therefrom when colliding with the first ball, the balls adapted to spin horizontally at a ninety degree angle with respect to the cord, the spinning balls colliding randomly with each other thereby causing random sound generation.

2. A variable sound producing tethered ball toy comprising:

a cord having two flat ends, a clip being formed in a rectangular configuration with a cross bar positioned thereacross, the cord being threaded through the clip causing the cord to be bent back upon itself, the two free ends of the cord depending from the clip;

a first ball fabricated of synthetic materials and formed in a spherical configuration, a free end of the cord being securely affixed to the ball; and a second ball fabricated of synthetic materials and formed in a spherical configuration, a free end of the cord being securely affixed to the ball; and at least one of the balls including a plurality of strips of synthetic material position on its surface, each strip emitting a different sound when struck by a ball.

3. The apparatus as set forth in claim 2 wherein at least one of the balls includes sound boxes which are formed in a long thin configuration, each sound box having a different vertical length and positioned vertically within the surface of the ball, a first sound box being the longest, a last sound box being the shortest and positioned adjacent to the first, a plurality of sound boxes of gradually decreasing vertical length being positioned around the ball between the first and last sound box.

4. The apparatus as set forth in claim 2 wherein both balls have strips of synthetic material coupled to their respective surfaces, each strip emitting a different sound when struck by a ball.

5. The apparatus as set forth in claim 2 wherein at least one of the balls includes sound varying devices within its interior, the sound varying devices emitting a variety of different sounds when struck by a ball.

6. The apparatus as set forth in claim 2 wherein the length of the cord is between six and twenty inches.

7. The apparatus as set forth in claim 2 wherein a pad is affixed around the approximate center point of the cord to prevent blistering of the fingers of the user, the length of the pad being variable thereby permitting the user to operate the apparatus with any number of fingers.

8. The apparatus as set forth in claim 6 wherein the second ball is divided into two separate hemispheres, an upper hemisphere including a bolt bore, a lower hemisphere including a bolt aperture extending therethrough, the edge of each hemisphere having a groove extending therein, a plurality of sound boxes being fabricated of synthetic materials and having differing widths, the sound boxes being positioned within the grooves and separated from each other by a short distance, the relative width of each sound box causing different sounds to emanate therefrom when colliding with the first ball, a bolt formed in a long cylindrical configuration being positioned through the bolt aperture and into the bolt bore, the bolt coupling the two hemispheres together and securing the sound boxes within the grooves.

* * * * *